United States Patent [19]

Clark et al.

[11] 4,129,498

[45] Dec. 12, 1978

[54] MAGNETIC SEPARATION

[75] Inventors: Norman O. Clark, Par; James H. P. Watson, St. Austell, both of England

[73] Assignee: English Clays Lovering Pochin & Co. Limited, Cornwall, England

[21] Appl. No.: 634,597

[22] Filed: Nov. 24, 1975

[30] Foreign Application Priority Data

Nov. 22, 1974 [GB] United Kingdom ..... 50801/74

[51] Int. Cl.[2] ..... B03C 1/16

[52] U.S. Cl. ..... 209/213; 209/222; 209/232

[58] Field of Search ..... 209/8.1, 214, 232, 5, 209/218, 227, 222, 223 A, 223 R; 210/222, 223; 193/2 D

[56] References Cited

U.S. PATENT DOCUMENTS

| | | | |
|---|---|---|---|
| 788,511 | 5/1905 | Besseberg | 210/354 |
| 933,717 | 9/1909 | Lockwood | 209/8.1 |
| 1,102,059 | 6/1914 | Lance | 193/2 D |
| 2,268,065 | 12/1941 | Smith | 210/354 |
| 2,954,122 | 9/1960 | Colburn | 209/214 X |
| 3,375,925 | 4/1968 | Carpenter | 209/232 X |
| 3,482,685 | 12/1969 | Mulder | 209/5 |
| 3,567,026 | 3/1971 | Koln | 210/222 |
| 3,902,994 | 9/1975 | Maxwell | 209/232 X |
| 3,920,543 | 11/1975 | Marston | 209/232 X |
| 3,994,801 | 11/1976 | Colburn | 209/232 X |

FOREIGN PATENT DOCUMENTS

| | | | |
|---|---|---|---|
| 625894 | 2/1936 | Fed. Rep. of Germany | 193/2 D |
| 37-14908 | 9/1962 | Japan | 209/218 |
| 21374 | 10/1904 | Sweden | 309/218 |
| 36444 | 12/1911 | Sweden | 209/218 |

*Primary Examiner*—Robert Halper
*Attorney, Agent, or Firm*—Armstrong, Nikaido, Marmelstein & Kubovcik

[57] ABSTRACT

A magnetic field is established in a predetermined zone. A quantity of fluid, from which native magnetizable particles are to be separated, is passed through the predetermined zone; and, at the same time, a magnetizable material is passed through the predetermined zone in the same direction as the fluid, so that native magnetizable particles are attracted to the magnetizable material.

17 Claims, 2 Drawing Figures

MAGNETIC SEPARATION

BACKGROUND OF THE INVENTION

This invention relates to magnetic separation and, more particularly, is concerned with a method of, and an apparatus for, separating magnetisable particles from a fluid containing them.

There are known apparatus, often referred to as wet magnetic separators, for separating a mixture of particles into a magnetisable fraction and non-magnetisable fraction. In such apparatus a slurry containing the mixture of particles is passed through a predetermined zone in which a magnetic field is established and the magnetisable particles, hereinafter referred to as the "native" magnetisable particles, are captured at collecting sites in the predetermined zone.

The force exerted on a spherical particle of magnetisable material in a magnetic field is given by the formula:

$$F = \chi\, m\, (\pi\, D^3/6) \cdot H \cdot dH/dx$$

where $m$ is the volume magnetic susceptibility of the material, $D$ is the diameter of the particle, H is the magnetic field intensity and $dH/dx$ is the rate of change of the magnetic field intensity with distance. From this expression it can be seen that, if both the diameter D and the volume magnetic susceptibility $\chi$ m of the particles are small, it is necessary to provide a high intensity magnetic field and/or a magnetic field whose intensity changes rapidly with distance. Thus, in many known types of magnetic separators, the predetermined zone in which the magnetic field is established is packed with a porous magnetisable material which has a sufficiently open structure for the flow of slurry through it not to be unduly impeded and which still provides a large number of collecting sites of high magnetic field intensity so that a very non-homogeneous magnetic field is established. The porous magnetisable material may comprise, for example: a stack of corrugated or ridged plates; a filamentary material, such as steel wool, wire mesh or bundles of wires or fibres; a particulate material, such as spheres, pellets or particles of more irregular shapes such as iron filings; or a metallic foam such as can be made, for example, by electroplating carbon-impregnated foam rubber and then removing the rubber with a suitable solvent.

For a simple wet magnetic separator in which a paramagnetic particle of radius R and magnetic susceptibility $\chi$ in a fluid of viscosity $\eta$ moves with velocity $V_o$ relative to a ferromagnetic wire or radius $a$ and a saturation magnetisation $M_s$ in a uniform magnetic field of intensity $H_o$ applied in a direction opposite to the direction of flow of the fluid, the longitudinal axis of the wire being oriented in a direction perpendicular to the direction of the magnetic field and to the direction of flow of the fluid, it can be shown mathematically that the chance of the paramagnetic particle being captured by the wire increases with the ratio $V_m/V_o$ where $V_m$ is a quantity having the dimensions of speed and given by the expression:

$$V_m = \frac{2}{9}\ \frac{(\chi\, H_o M_s R^2)}{(\eta\, a)}$$

Therefore, in order to maximise the number of native magnetisable particles captured by the wire without increasing the value of magnetic field intensity $H_o$, it is necessary to minimise the value of $V_o$. This relationship applies for magnetic separators utilising more complex magnetisable materials to separate a number of native magnetisable particles of differing size and differing magnetic susceptibilities from a fluid.

SUMMARY OF THE INVENTION

According to one aspect of the present invention, there is provided a method of separating native magnetisable particles from a fluid having such particles in suspension therein, which method comprises:

establishing a magnetic field in a predetermined zone, adding foreign magnetisable particles to the fluid, from which native magnetisable particles are to be separated, the foreign magnetisable particles being relatively large in relation to the native magnetisable particles, passing the fluid and the native and foreign magnetisable particles into the predetermined zone by means of a chain means which is moved by the action of the fluid and particles on transverse members attached to the chain means, so that native magnetisable particles are magnetised and attracted to foreign magnetisable particles within the predetermined zone, and removing the foreign magnetisable particles and entrained native magnetisable particles from the fluid.

In the case of the material being ferromagnetic, the native magnetisable particles to be separated from the fluid may be paramagnetic or ferromagnetic. However, in the case of the material being paramagnetic, the native magnetisable particles to be separated from the fluid must be ferromagnetic.

The method of the invention enables the value of $V_o$, the velocity of the fluid relative to a given point in the magnetisable material, to be reduced to a low value or even to zero and consequently the ratio $V_m/V_o$ may be maximised. The closer are the values of the velocities of the fluid and the magnetisable material, the greater is the number of native magnetisable particles attracted to the magnetisable material. Therefore the chance of capture of a native magnetisable particle of given size and magnetic susceptibility by the magnetisable material in a field of given intensity is increased relative to the case in which the fluid has a higher velocity relative to the magnetisable material. A given separation of native magnetisable particles may therefore be performed in a magnetic field of lower intensity than is necessary in a conventional magnetic separating process, or alternatively, for a given magnetic field intensity, the throughput of fluid containing native magnetisable particles through the separating chamber may be higher than in the case of a conventional magnetic separation process, or, of course, the degree of separation of native magnetisable particles from the fluid can be greater for a given field intensity and a given throughout of fluid.

Preferably the linear rate of flow of the fluid and the rate of movement of the magnetisable material do not differ by more than a factor of two. The linear rate of flow of the fluid, and therefore also the rate of movement of the magnetisable material, may vary over a wide range, for example from 30 cm/min. to 2000 cm/min.

According to another aspect of the present invention, there is provided apparatus for separating native magnetisable particles from a fluid having such particles in suspension therein, which apparatus comprises means for establishing a magnetic field in a predetermined zone of the apparatus, guide means passing through said predetermined zone, inlet means for introducing the fluid, native magnetisable particles, and foreign magnetisable particles into the guide means, the foreign magnetisable particles being relatively large in relation to the native magnetisable particles, a chain means for passing the fluid and the native and foreign magnetisable particles within the guide means into the predetermined zone under the effect of the fluid and particles acting on transverse members attached to the chain means, so that native magnetisable particles are magnetised and attracted to foreign magnetisable particles within the predetermined zone, and extracting means for extracting the foreign magnetisable particles and entrained native magnetisable particles from the fluid.

In the case of the magnetisable material being ferromagnetic, the ferromagnetic material is conveniently particulate or filamentary. A filamentary ferromagnetic material may, for example, be constituted by a mesh woven from ferromagnetic wires, by a corrosion-resistant steel wool formed from an alloy steel in the ferritic or martensitic state having a chromium content in the range from 4% to 27% by weight, or by an expanded metal mat. The filaments are advantageously ribbon-shaped. A particulate ferromagnetic material may be constituted by particles of substantially spherical, cylindrical or cubic shape or by particles of a more irregular shape, such as, for example, that obtained when a block of corrosion-resistant ferromagnetic material is subjected to the action of a milling machine; thus, for example, the material may be constituted by jagged iron filings or very finely chopped pieces of steel wool.

Depending on the nature of material utilised, the ferromagnetic material may be contained within a foraminous casing of magnetic or non-magnetic material. The size of the apertures in the casing should be such that little resistance is offered to the passage of the fluid or the particles in suspension therein.

In one form, the ferromagnetic material is disposed as an endless loop. Some of the materials described above may be fashioned into this form without the use of a casing. For example, the loop may be constituted by a steel rope formed of a plurality of twisted steel filaments. However, many materials will require the use of a hollow casing constructed in the form of a closed loop and packed with the material in order to assume this form. Preferably the material is so packed within the casing that there is no relative movement between the material and the casing when the casing is moved.

The ferromagnetic material in the form of a loop (either provided with a casing or not) may then be passed around two pulley wheels, one of which is arranged to be driven by a motor, and may be disposed with respect to an elongate trough, provided for the flow of fluid containing native magnetisable particles along its length, such that it will pass through the flowing fluid parallel to the direction of flow.

In one embodiment of the method of the present invention, said method comprises establishing a magnetic field in a predetermined zone, adding foreign particulate magnetisable material to the fluid, from which native magnetisable particles are to be separated, the particles of the foreign magnetisable material being relatively large in relation to the native magnetisable particles, passing the fluid and the foreign magnetisable material through the predetermined zone, so that the native magnetisable particles are attracted to the foreign magnetisable material, and removing the foreign magnetisable material and entrained native magnetisable particles from the fluid.

In one embodiment of the apparatus of the present invention, said apparatus comprises means for establishing a magnetic field in a predetermined zone of the apparatus, guide means passing through said predetermined zone, inlet means by way of which fluid, from which native magnetisable particles are to be separated, and particulate foreign magnetisable material are intended to be introduced into the guide means, the particles of the foreign magnetisable material being relatively large in relation to the native magnetisable particles, moving means for passing the fluid and the foreign magnetisable material within the guide means through the predetermined zone, the arrangement being such that native magnetisable particles are magnetised and attracted to the foreign magnetisable material within the predetermined zone, extracting means for extracting the foreign magnetisable material and entrained native magnetisable particles from the fluid, and an outlet for the fluid from which native magnetisable particles have been separated.

Preferably the particles of the foreign magnetisable material have diameters at least five times larger than the diameters of the native magnetisable particles. The particles of the foreign magnetisable material generally have diameters between about 50 microns and 500 microns whereas the diameters of the native magnetisable particles are generally of the order of 10 microns or less.

Preferably the extracting means is constituted by a chain provided with a plurality of magnetisable spikes or fin-like projections, which chain is passed through the fluid within the predetermined zone in substantially the same direction as the flow of fluid through the predetermined zone to attract the foreign magnetisable material when the apparatus is in use. The chain may be in the form of an endless chain, at least part of which is contained within the guide means. The moving means may be constituted by a plurality of transverse members spaced along the chain, the guide means and the chain being so disposed that, in use, the fluid and particulate foreign magnetisable material passing through the inlet act on the transverse members so as to move the chain which, in turn, passes fluid and foreign magnetisable material through the predetermined zone.

It is advantageous if means are provided for agitating the particulate foreign magnetisable material within the fluid before it is passed through the predetermined zone. The means may be constituted by a rotating magnetic field system.

Provided the particles of the foreign magnetisable material are fairly evenly spaced throughout the fluid passing through the separating chamber, a large number of points at which the local magnetic field intensity is high will be provided within the separating chamber, and, since a very inhomogeneous magnetic field is especially desirable for separating native magnetisable particles, a high degree of magnetic separation will result.

Means may be provided within the predetermined zone for removing non-magnetisable particles which have been collected by the magnetisable material. Furthermore, removal means may be provided outside the predetermined zone for removing native magnetisable particles which have been collected by the magnetisable material. These means may incorporate a degaussing coil. These removal means may also be utilised to remove the magnetisable material from the chain so that the material may be cleaned before being reintroduced into the guide means together with fresh fluid having native magnetisable particles in suspension therein.

BRIEF DESCRIPTION OF THE DRAWINGS

For a better understanding of the invention and to show more clearly how the same may be carried into effect reference will now be made, by way of example, to the accompanying drawings, in which.

DETAILED DESCRIPTION OF THE DRAWINGS

Figure 1:
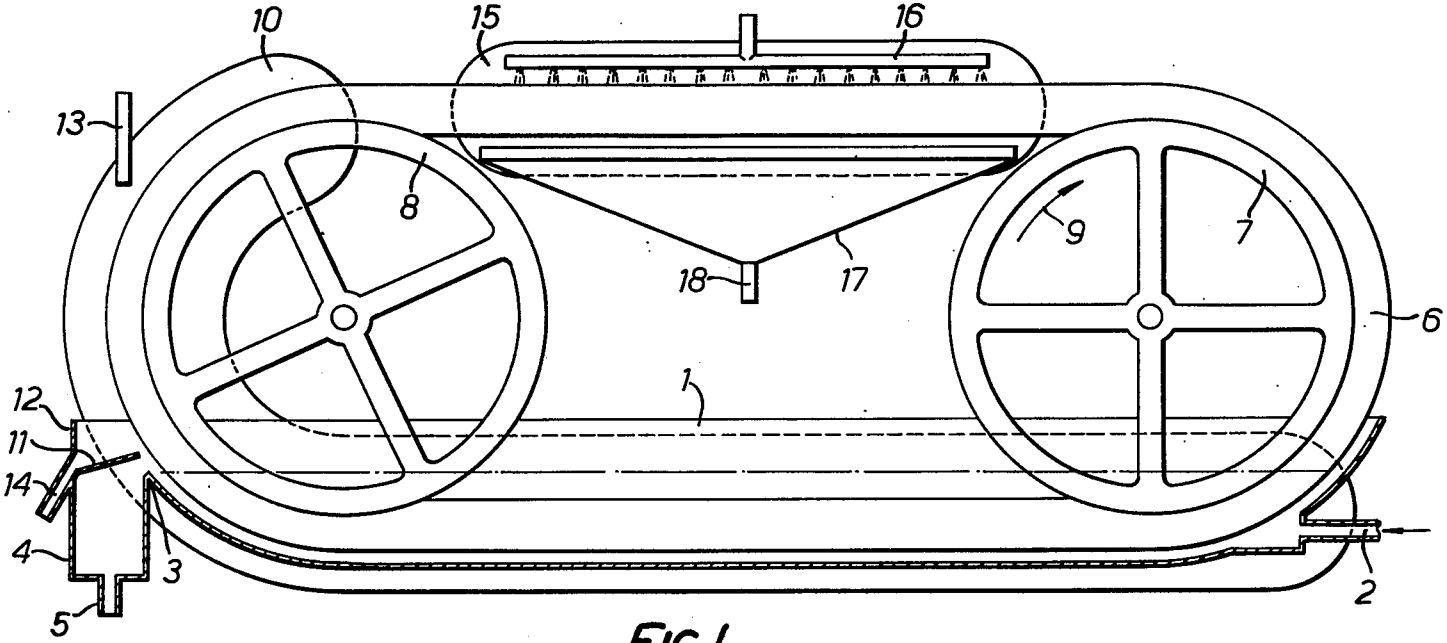
FIG. 1 shows diagrammatically one embodiment of the apparatus according to the present invention.

The embodiment shown in FIG. 1 comprises an elongated trough 1 which is provided at one end with an inlet 2 for an aqueous suspension of a mixture of magnetisable and substantially non-magnetisable particles, and at the other end with a weir 3. The height of the weir determines the level of the liquid in the trough. Liquid flows from the inlet 2, along the length of the trough, over the weir 3 and into a container 4 which is provided with an outlet 5.

A continuous belt 6, comprising a ferromagnetic matrix of stainless iron wool enclosed in a casing of bronze wire mesh having an aperture size of approximately 150 microns, passes over two pulley wheels 7 and 8 and, between the pulley wheels, through the liquid in the trough 1. Pulley wheel 7 is driven in the direction shown by the arrow 9 by, for example, an electric motor (not shown), and the belt 6 is thus moved through the liquid in the trough 1 in the same direction as the flow of liquid along the length of the trough. Around the peripheries of the pulley wheels are a plurality of small spikes (not shown) which engage the continuous belt 6.

A conventional electromagnet having two elongated curved pole pieces 10, one of which is positioned each side of the trough 1, is provided for applying a magnetic field to the liquid in the trough. As the belt 6 moves through the trough, preferably at a speed of approximately the same magnitude as the rate of flow of the liquid along the length of the trough, the magnetisable particles within the liquid are magnetised by the applied magnetic field and are attracted to the ferromagnetic matrix. Substantially non-magnetisable particles are also mechanically caught up by the ferromagnetic matrix. In the region in which the continuous belt leave the trough a partition 11 is provided which also forms the base of a hopper 12. The hopper 12 is utilised to collect the substantially non-magnetisable particles which are only loosely held by the filaments of the ferromagnetic matrix. These particles are easily removed by spraying with clean water from a spray nozzle 13. The water and the substantially non-magnetisable particles, removed from the matrix, fall into the hopper 12 and are discharged through an outlet 14. After passing round the pulley wheel 8, the belt 6 leaves the influence of the electromagnet pole pieces 10 and passes between the pole pieces 15 of a degaussing coil which is supplied with an alternating current. The amplitude of the alternating current is varied cyclically between a finite value and zero so as to take the value of the magnetisation of the ferromagnetic matrix around a smaller and smaller hysteresis loop until the residual magnetism within the matrix is effectively zero. As the belt passes between the pole pieces 15, clean water at high pressure is sprayed on to the belt from a perforated conduit 16 and the magnetisable particles are flushed out of the matrix and collected in a hopper 17 provided with an outlet 18.

The magnetic field strength utilised in such a magnetic separator is generally about 5,000 gauss.

Figure 2:
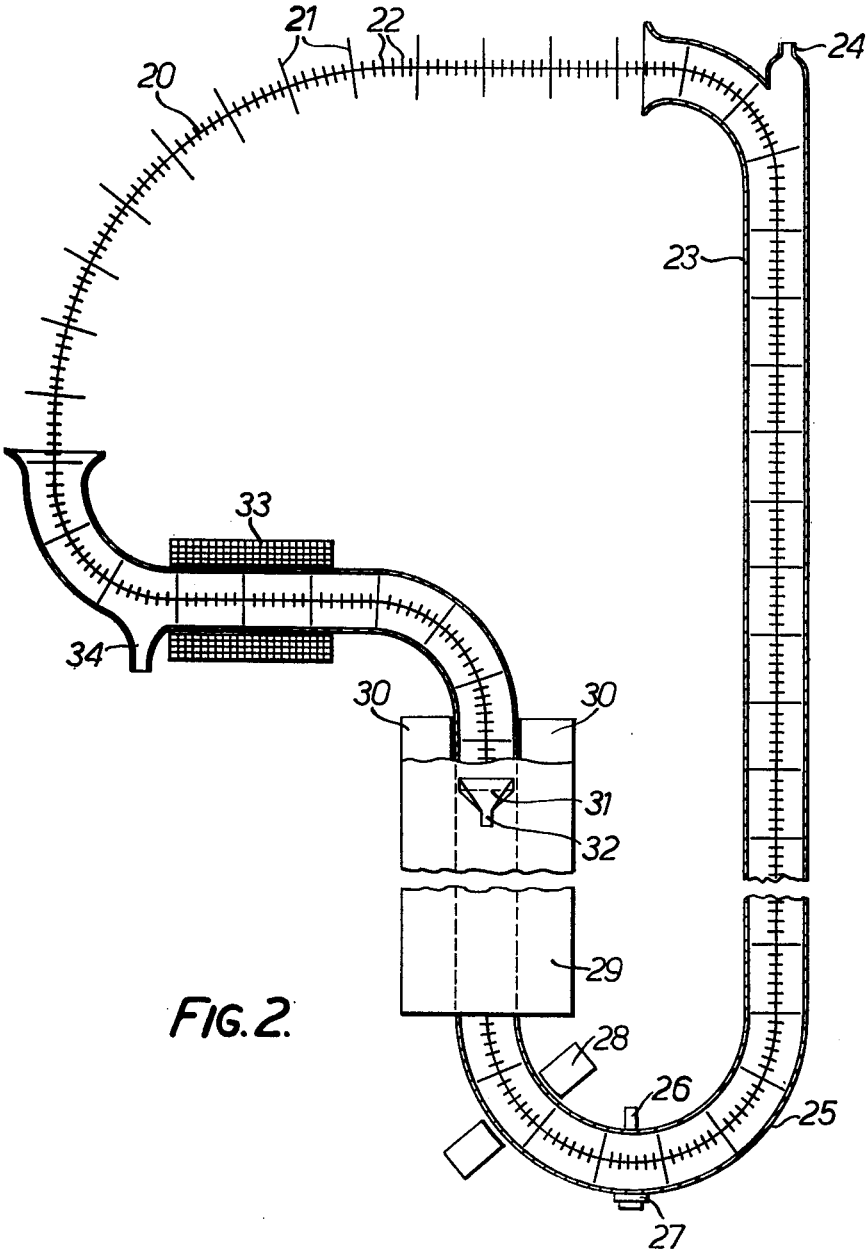
FIG. 2 shows diagrammatically a second embodiment of the apparatus according to the invention.

The embodiment shown in FIG. 2 comprises a continuous chain 20 provided with a plurality of circular transverse members 21 spaced along the chain 20 and a plurality of transverse ferromagnetic spikes 22 disposed along the chain between the members 21. The chain 20 passes through a guide tube 23 made of a non-magnetisable material and of circular cross-section within which the members 21 are a sliding fit. Through an inlet 24 of the tube 23, there is fed a slurry, which comprises a mixture of water and mineral particles which are to be separated into magnetisable and non-magnetisable particles, and foreign ferromagnetic particles having diameters in the range from 50 microns to 500 microns. The weight of the slurry and foreign ferromagnetic particles on the members 21 causes the chain to travel through the guide tube 23, which is disposed substantially vertically in the region of the inlet 24, in a clockwise direction as seen in FIG. 2.

The guide tube 23 extends downwards from the inlet 24 for a large distance (not that part of the tube 23 is not shown in FIG. 2 for convenience) before bending around into a U-shaped portion 25. In this region, there are provided an inlet 26, through which may be injected additional water and/or a deflocculant for the mineral particles, and a drain plug 27 to facilitate the removal of any solid material which may accumulate at the bottom of the U-shaped portion 25 of the guide tube. After the U-shaped portion 25, the guide tube 23 enters a magnetic separating chamber 29. Immediately before the guide tube enters the chamber 29, a ring 28 of four or more electromagnet coils carrying alternating currents encircles the guide tube. The alternating currents supplied to these coils are phased in such a way that a rotating magnetic field is applied to the slurry within the guide tube in the region of the ring 28. The rotating magnetic field agitates the foreign ferromagnetic particles in the slurry and causes thorough mixing of the slurry and the foreign ferromagnetic particles.

The chain 20 carrying with it the mixed slurry and foreign ferromagnetic particles is then brought within the guide tube into the separating chamber 29 which is provided with two elongated electromagnet coils 30 which may be used to establish a magnetic field having an intensity of about 5,000 gauss in a direction substantially transverse to the chain 20 in that region. In the magnetic separating chamber 29, the native magnetisable particles in the mixture of mineral particles are magnetised by the applied magnetic field and are attracted to the foreign ferromagnetic particles which, in turn, are attracted to the ferromagnetic spikes 22 on the chain 20. Close to the upper end of the separating chamber 29, the slurry, now comprising a suspension of predominantly non-magnetisable particles in water, flows over a weir 31 and is discharged through an outlet 32 (projecting out of the paper in the drawing).

The chain 20, still within the guide tube 23, draws the foreign ferromagnetic particles and adhering native magnetisable particles out of the separating chamber 29 and the influence of the magnetic field, bends through a right angle so that it is substantially horizontal, and then passes through a degaussing coil 33 which is supplied with alternating current, the amplitude of which is varied cyclically between a finite value and zero in order to demagnetise the ferromagnetic spikes 22 and the foreign ferromagnetic particles. The foreign ferromagnetic particles and native magnetisable particles are therefore released from the spikes and fall under the influence of gravity to the wall of the guide tube immediately below. They are swept along the guide tube and into an outlet 34 by the members 21. The foreign ferromagnetic particles are separated from the native magnetisable particles by means of a sieve of suitable aperture size and are returned for mixing with incoming slurry.

After the outlet 34 the guide tube 23 ends and the chain 20 passes for some distance unguided by the tube until it again enters the tube in the region of the inlet 24. Such a construction serves to reduce the friction on the chain 20 caused by the sliding contact between the members 21 and the tube wall. However, it is envisaged that a construction in which the chain is completely enclosed by the tube, which therefore forms a closed loop, is possible.

Since the foreign ferromagnetic particles are caused by the members 21 on the chain 20 to travel through the zone in which the magnetic field is established at substantially the same velocity as the slurry of mineral particles, the value of $V_m/V_o$ is high.

EXAMPLE

A feed slurry, containing in water, 25% by weight of a kaolin clay, having a particle size distribution such that 45% by weight consisted of particles having an equivalent spherical diameter smaller than 2 microns and 15% by weight consisted of particles having an equivalent spherical diameter larger than 10 microns, the slurry containing 0.36% by weight, based on the weight of dry kaolin, of sodium silicate as a deflocculant and sufficient sodium carbonate to raise the pH to 8.5, was passed through a magnetic separator substantially as described with reference to FIG. 1, the flow rate of the slurry and the velocity of the matrix belt being adjusted to give relative velocities between the slurry and the belt which varied over a wide range. Experiments were also performed at three different levels of magnetic field intensity. In each experiment the product slurry was sampled and the sample dried and tested for reflectance to violet light having a wavelength of 458 nm. The results are given in Table I below.

TABLE I

| Magnetic field intensity (tesla) | Relative velocity between slurry and belt (cm/min.) | % reflectance to light of wavelength 458 nm. |
|---|---|---|
| 0.6 | 5 | 90.5 |
| " | 25 | 89.6 |
| " | 34 | 89.1 |
| " | 50 | 89.0 |
| " | 66 | 88.5 |
| " | 220 | 87.8 |
| 0.2 | 5 | 89.2 |
| " | 26 | 88.3 |
| " | 43 | 87.6 |
| " | 77 | 86.5 |
| " | 97 | 86.5 |

TABLE I-continued

| Magnetic field intensity (tesla) | Relative velocity between slurry and belt (cm/min.) | % reflectance to light of wavelength 458 nm. |
|---|---|---|
| 0.1 | 5 | 88.6 |
| " | 15 | 87.9 |
| " | 40 | 87.0 |
| " | 82 | 86.3 |
| " | 105 | 86.2 |

The reflectance to light of 458 nm wavelength of the dry feed kaolin was 84.4 and in each case the absolute velocity of the slurry through the magnetic separator was 220 cm/min. It can be seen from these results that the improvement in brightness obtained using a magnetic field of intensity 0.2 tesla and a relative of 5 cm/min. is comparable with that obtained with a magnetic field of intensity 0.6 tesla and a relative velocity of 34 cm/min.

Even with a magnetic field intensity as low as 0.1 tesla and a relative velocity of 5 cm/min., the improvement in brightness is comparable with that obtained with a field intensity of 0.6 tesla and a relative velocity of 66 cm/min. The magnetic separator utilized in these experiments, therefore, makes it possible to achieve a given improvement in brightness of the kaolin by removing the dark-colored iron compounds at a lower magnetic field intensity than would be possible with a conventional magnetic separator, with consequent savings in magnet and power costs, while maintaining a high absolute flow rate of slurry through the magnetic separator.

I claim:

1. A method of separating native magnetisable particles from a fluid having such particles in suspension therein, which method comprises:

establishing a magnetic field in a predetermined zone, adding foreign magnetisable particles to the fluid, from which native magnetisable particles are to be separated, the foreign magnetisable particles being relatively large in relation to the native magnetisable particles, passing the fluid and the native and foreign magnetisable particles into the predetermined zone by means of a chain means which is moved by the action of the fluid and particles on transverse members attached to the chain means, so that native magnetisable particles are magnetised and attracted to foreign magnetisable particles and the foreign magnetizable particles and the entrained native magnetisable particles are magnetically attracted to magnetizable portions of the chain means within the predetermined zone, and removing the foreign magnetisable particles and entrained native magnetisable particles from the fluid by means of the chain means.

2. A method as claimed in claim 1, wherein the magnetic field strength is about 5000G.

3. A method as claimed in claim 1, wherein native and foreign magnetisable particles are removed from the fluid by being magnetised and attracted to magnetisable spikes or fin-like projections on the chain means while said particles are within the predetermined zone, and by being carried out of the predetermined zone by the chain means.

4. A method as claimed in claim 3, wherein the fluid, after separation of native and foreign magnetisable particles therefrom, flows over a weir in the predetermined zone and is discharged from the predetermined zone.

5. A method as claimed in claim 3, wherein native and foreign magnetisable particles are removed from the spikes or fin-like projections on the chain means by passing the chain means through a degaussing coil which is supplied with alternating current, the amplitude of which is varied cyclically between a finite value and zero.

6. A method as claimed in claim 5, wherein the foreign magnetisable particles are separated from the native magnetisable particles by means of a sieve.

7. A method as claimed in claim 1, wherein the foreign magnetisable particles have diameters at least five times larger than the diameters of the native magnetisable particles.

8. A method as claimed in claim 1, wherein the foreign magnetisable particles are agitated within the fluid by a rotating magnetic field before being passed through the predetermined zone.

9. A method as claimed in claim 1, wherein the fluid containing native and foreign magnetisable particles is deffloccculated before being passed through the predetermined zone.

10. A method as claimed in claim 1, wherein the foreign magnetisable particles are constituted by ferromagnetic material.

11. Apparatus for separating native magnetisable particles from a fluid having such particles in suspension therein, which apparatus comprises:

means for establishing a magnetic field in a predetermined zone of the apparatus, guide means extending through said predetermined zone, inlet means for introducing the fluid, native magnetisable particles, and foreign magnetisable particles into the guide means, the foreign magnetisable particles being relatively large in relation to the native magnetisable particles, a chain means for passing the fluid and the native and foreign magnetisable particles within the guide means into the predetermined zone under the effect of the fluid and particles acting on transverse members attached to the chain means, so that native magnetisable particles are magnetised and attracted to foreign magnetisable particles within the predetermined zone, and extracting the foreign magnetisable particles and entrained native magnetisable particles from the fluid by magnetically attracting the foreign magnetizable particles and the entrained native magnetizable particles to magnetisable portions of the chain means within the predetermined zone.

12. Apparatus as claimed in claim 11, wherein the magnetizable portions comprise spikes or fin-like projections on the chain means, to which native and foreign magnetisable particles within the predetermined zone may be attracted after having been magnetised by the magnetic field established in the predetermined zone, so that these particles may be carried out of the predetermined zone by the chain means.

13. Apparatus as claimed in claim 12, wherein removal means are provided outside the predetermined zone for removing native and foreign magnetisable particles from the spikes or fin-like projections on the chain means.

14. Apparatus as claimed in claim 13, wherein the removal means incorporate a degaussing coil.

15. Apparatus as claimed in claim 11, wherein the chain means is in the form of an endless belt, at least part of which is contained within the guide means.

16. Apparatus as claimed in claim 11, wherein means are provided for agitating the foreign magnetisable particles within the fluid before being passed through the predetermined zone.

17. Apparatus as claimed in claim 16, wherein the agitating means comprises a rotating magnetic field system.

* * * * *